United States Patent [19]

Dolizy, deceased et al.

[11] Patent Number: 4,982,136

[45] Date of Patent: Jan. 1, 1991

[54] X-RAY IMAGE INTENSIFIER TUBE

[75] Inventors: Pierre M. Dolizy, deceased, late of Ris-Orangis; by François Charpail, legal representative, Paris, both of France

[73] Assignee: U.S. Philips Corporation, New York, N.Y.

[21] Appl. No.: 274,530

[22] Filed: Nov. 21, 1988

[30] Foreign Application Priority Data

Nov. 24, 1987 [FR] France ..... 87 16252

[51] Int. Cl.[5] ..... H01J 31/50; H01J 40/18

[52] U.S. Cl. ..... 313/527; 313/530

[58] Field of Search ..... 313/530, 527

[56] References Cited

U.S. PATENT DOCUMENTS

| | | | |
|---|---|---|---|
| 2,666,864 | 1/1954 | Longini | 313/527 |
| 2,681,868 | 6/1954 | Mason et al. | 313/527 X |
| 3,473,066 | 10/1969 | Bates, Jr. et al. | 313/527 |
| 3,852,632 | 12/1974 | Franz et al. | 313/527 |
| 4,447,721 | 5/1984 | Wang | 313/527 X |

OTHER PUBLICATIONS

"Coloured Glasses" by W. A. Weyl, Society of Glass Technology–Publisher, 1967, pp. 6, 8, 271, 274.

*Primary Examiner*—Palmer C. Demeo

*Attorney, Agent, or Firm*—Bernard Tiegerman

[57] ABSTRACT

An aluminum substrate which supports a scintillator transforms X-rays into visible or nearly visible light radiation which is converted into a flux of electrons by means of a photocathode. The flux produces a visible image on an exit screen through electro-optical means. A layer which absorbs the light radiation emitted by the scintillator in the direction of the aluminium substrate is inserted between the aluminium substrate and the scintillator, the absorbing layer consisting of a material chosen from the following materials: titanium nitride, cadmium sulphide, (Cu, $OhI_2$). A layer having a low optical index can be inserted between the scintillator and the photocathode. A chemical barrier may also be inserted between the scintillator and the photocathode. An electrically conductive and optically transparent layer can be inserted between the photocathode and the chemical barrier.

11 Claims, 3 Drawing Sheets

X-RAY IMAGE INTENSIFIER TUBE

BACKGROUND OF THE INVENTION

The invention relates to an X-ray image intensifier tube, comprising an entrance screen provided with an aluminum substrate which supports a scintillator for transforming X-rays, which reach the scintillator through the substrate, into visible or nearly visible light radiation which is converted, by way of a photocathode, into a flux of electrons to produce a visible image on an exit screen via electron-optical means.

A device of this kind is disclosed in the document FR No. 2 515 423. It describes an entrance secreen which is suitable for use in a brightness intensifier tube offering an improved resolution. To this end, the columnar cesium iodide crystals constituting the scintillator stem from impurity particles on the surface of the aluminum substrate. A secondary effect of these surface impurities is that they stimulate the absorption of the light emitted in the direction of the substrate. Because the light-guided effect of the columnar crytals is not perfect, this absorption of the light by the impurity particles improves the contrast of the image formed. These impurity particles form seeds for growing the columnar crystals. Therefore, they must be islands disseminated across the surface of the aluminum substrate, which islands are made formed by an appropriate chemical process. The light emitted by the scintillator in the direction of the substrate is thus only secondarily absorbed by these impurity particles whose presence and nature are random.

The problem to be solved, therefore, consists in the construction of a tube comprising an entrance window having a high resolution for the entire area of the image formed. The performance of the tube must be reproducible and reliable.

SUMMARY OF THE INVENTION

A layer which absorbs the light radiation emitted by the scintillator in the direction of the aluminum substrate is provided between the aluminum substrate and the scintillator. The absorbing layer consists of a marerial chosen from the following materials: titanium nitride, cadmium sulphide, (Cu, $PbI_2$).

However, considering the high refractive index of the material of the photocathode, another mechanism contributes to the deterioration of the resolution. It is due to light radiation emitted by the scintillator which is very remote from the normal to the surface of the photocathode and which can penetrate therein. In order to eliminate such light radiation which is very remote from the normal, in accordance with the invention between the scintillator and the photocathode there is inserted a low-index layer having a refractive index which is lower than that of the photocathode. The material of this layer can be chosen from the following materials: $MgF_2$, cryolite ($Na_3AlF_6$).

The scintillator marerial is chosen from the following materials: CsI(Na), NaI(Tl), CsI(Tl), $CdWO_4$, $Bi_4Ge_3O_{12}$, $CaWO_4$.

The radiation is directed towards the substrate being observed, low tube luminosity may arise when use is made of a conventional $Cs_3Sb$ photocathode.

A secondary problem consists in that a high luminosity must be obtained while maintaining the resolution of the tube.

The solution to this secondary problem consists in that the photocathode material is chosen from the following materials: $k_2CsSb$, $Rb_2CsSb$, ($SbNa_2K$, Cs); the latter material may be of the type S20 or S25, depending on its spectral response. These designations are known to those skilled in the art. All these materials result in a long service life for the tube.

Thus, a tube having a higher resolution and a high luminosity is obtained.

In order to ensure an optimum service life for the tube, it is desirable to insert, between the scintillator and the photocathode, a chemical barrier consisting of a layer chosen from the following materials: $Al_2O_3$, $Si_3N_4$, $SiO_2$. This chemical barrier prevents the sodium present in the scintillator from migrating towards the photocathode.

The collecting of the charges can also be improved by providing an electrically conductive and optically transparent layer between the photocathode and the chemical barrier. This layer is chosen from the folowing materials: palladium, aluminum $In_2O_3$, $SnO_2$, ITO (a mixture consisting for 90% of $In_2O_3$ and for 10% of $SnO_2$).

DETAILED DESCRIPTION OF THE PREFERRED EMBODIMENTS

Figure 1:
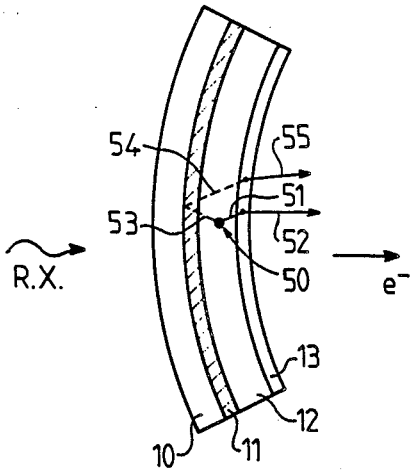
FIG. 1 diagrammatically shows an entrance window of an X-ray image intensifier tube in accordance with the invention.

The entrance window in FIG. 1 comprises successively an aluminum substrate 10, an absorbing layer 11, a scintillator 12 and a photocathode 13. The incident X-rays reach the structure through the substrate 10 and electrons e- are emitted by the photocathode 13. These electrons are focussed in advance by means of electron optical means (not shown) and serve to form a visible image on an exit screen (not shown). When the X-rays are absorbed at a point 50 in the scintillator, visible radiation is emitted. For example, the beam 51 enters the photocathode 132 which emits electrons 52. However, the same point 50 can emit beams, such as the beam 53, in the direction of the substrate 10. in the absence of the absorbing layer 11, the beam 53 would be reflected as the beam 54 and electrons 55 would be emitted by the photocathode. Thus, the point produces several electron emissions 52, 55, resulting in a deficiency in the resolution of the tube.

In accordance with the invention, the beams 53 emitted in the direction of the substrate are absorbed. However, the absorption should be continuous and homogeneous across the entire surface of the entrance window in order to produce an image of uniform quality. The absorption should be as high as possible for the wavelength of the light emitted by the scintillator. The scintillators can be chosen from the following materials: CsI(Na), NaI(Tl), CsI(Tl), $CdWO_4$, $Bi_4Ge_3O_{12}$, $CaWO_4$. For example for a CsI(Na) scintillator, the wavelength of the light emitted is approximately 430 nm. (A useful thickness for such a CsI(Na) scintillator layer ranges from approximately 100 to approximately 1000 micrometers.) The absorbing layer must enable absorption of this radiation. In accordance with the invention, the material may be chosen from the following materials: TiN, CdS, (Cu, $PbI_2$). The optical indices $n^*=n-ik$, where n is the refractive index and k is the extinction index, are $n=1.65$ and $k=0.79$ for TiN and $n=2.5$ and $k=0.2$ for CdS. They are given by way of example for a wavelength of 430 nm and vary little as the wavelength varies.

Figure 2:
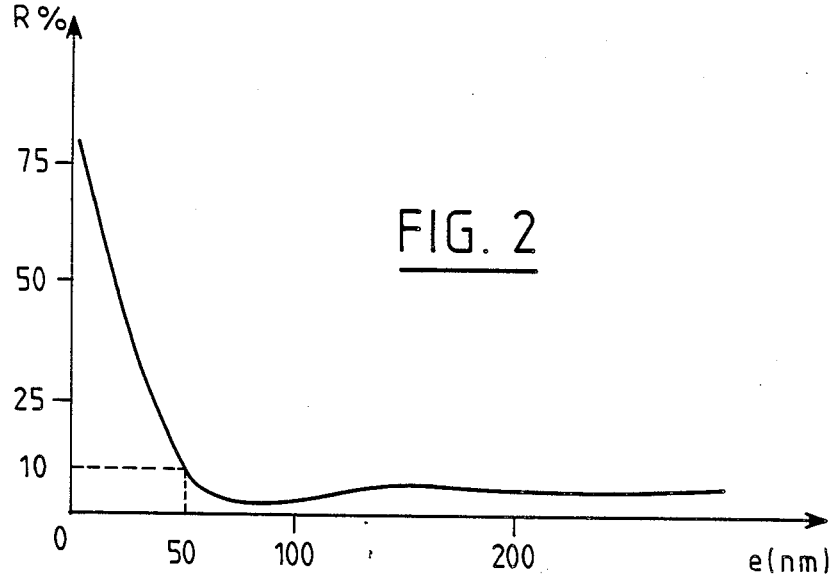
FIG. 2 shows a curve representing the variation of the reflection factor of a layer of TiN deposited on an aluminum substrate as a function of the thickness of the layer of TiN.

FIG. 2 shows the reflection factor of a layer of TiN deposited on an aluminium substrate for light having a wavelength of 430 nm emitted by a CsI(Na) scintillator. This factor is represented as a function of the thickness of the absorbing layer. It is apparent that the reflecting factor becomes less than 10% for a TiN layer having a thickness of at least approximately 50 nm. As shown in FIG. 2, a thickness ranging from about 75 nm to about 120 nm results in a reflection factor which is significantly less than 10%.

Figure 3:
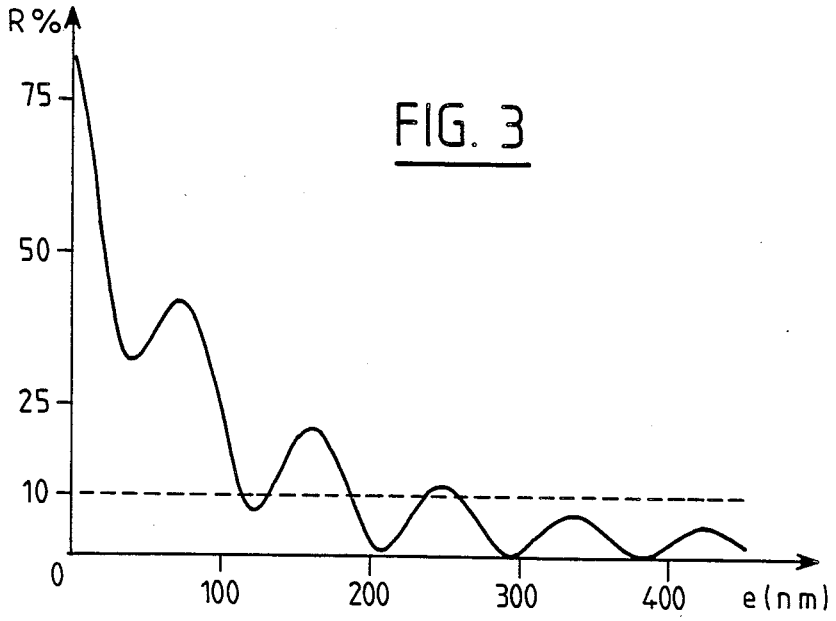
FIG. 3 shows a curve analogous to that of FIG. 2 for a layer of CdS.

A similar situation occurs for other materials such as CdS or (Cu, $PbI_2$). FIG. 3 shows the reflection factor for a layer of CdS, deposited on an aluminum substrate, for a wavelength of 430 nm as a function of the thickness of the layer. For cadmium sulphide $n=2.5$ and $k=0.2$. Thus, oscillations occur in the curve shown in FIG 3. Therefore, thicknesses can be determined for CdS layers for which the reflection factor is sufficiently unimportant. Thus, when a factor of less than 10% is chosen, the thicknesses of CdS may be chosen substantially in the following ranges: 115 nm to 135 nm, 185 nm to 235 nm, and higher than 260 nm for a luminous emission at 430 nm, Each scintillator will have a light spectrum centered around a central wavelength which is specific of the relevant scintillator. These light spectra are distributed between substantially 400 nm substantially 600 nm. The layer thicknesses of CdS can thus be directly determined in accordance with an admissible predetermined value for the reflection factor and as a function of the central emission wavelength of the scintillator used. Those skilled in the art can thus easily choose the thickness as a funciton of the tolerated reflection factor by preliminary measurement of the reflection factor as a function of the thickness for the wavelength and the material chosen.

Figure 4:
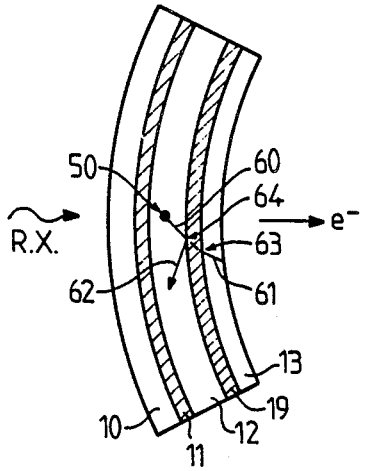
FIG. 4 is a diagrammatic representation which is analogous to that shown in FIG. 1, with an addition in the form of a low-index layer between the scintillator and the photocathode.

FIG. 4 shows an embodiment of the invention which comprises a supplement in the form of a layer 19 having a low refractive index which is inserted between the scintillator 12 and the photocathode 13. When a light beam 60 originating from the point 50 is considered in the absence of the layer 19, it arrives at the point 63 and penetrates the photocathode as a light beam 61 and produces electrons therein. However, the point 63 may be situated very far from the radial direction from the point 50 perpendicular to the surface curvature of the photocathode, which direction is substantially the axial direction of the columnar crystals. The electrons from the ray 61 will thus contribute to the deterioration of the resolution of the image of the tube. This second cause of a decreasing resolution is corrected by means of a low-index layer 19 having a refractive index which is lower than that of the scintillator 12, which layer is inserted between the scintillator 12 and the photocathode 13. Thus, the ray 60 strikes the surface of this layer at the point 64 and is subjected to a total reflection as denoted by the beam 62. The light rays which are substantially remote from the axial direction of the columnar crystals are returned and do not participate in the formation of electrons. This layer 19 must have a low absorption so as not to disturb the luminosicity. The material of this layer may be chosen from the following materials: $MgF_2$, cryolite ($Na_3ALF_6$). In the range of useful wavelengths, situated between approximately 400 nm and 600 nm, the refractive index of $MgF_2$ lies between 1.33 and 1.37 approximately and the extinction index is substantially zero. The values are substantially similar for cryolite.

This absorption and light reflection, resulting in an increased resolution of the tube, are accompnied by a low luminosicity of the tube. It may be desirable to increase this luminosicity. To this end, use can be made of other photocathode materials such as: $K_2CsSb$, $Rb_2CsSb$, ($SbNa_2K$, Cs). They offer a photoelectric yield which is higher than that of the customary material $Cs_3Sb$.

When the photoelectric yield of the construction formed by $Cs_3Sb$ photocathode in association with a scintillator (csI, Na) is normalized to 1, a yield of 1.60 is obtained for a photocathode ($SbNa_2K$, Cs) and a yield of 2.32 is obtained for a photocathode $K_2CSSb$. Photocathodes made of the materials $K_2CsSb$, $Rb_2CsSb$, or ($SbNa_2K$, Cs) are thus very suitable for improving the luminosicity deteriorated by the absorbing layers of TiN. On the other hand, they impart a long service life to the construction.

However, in order to impart an optimum service life to such a construction, it is desirable to insert a chemical barrier between the scintillator and the photocathode in order to prevent the element Na from migrating towards the photocathode during the manufacture of the tube. This chemical barrier is formed by a layer which is chosen from the following materials: $Al_2O_3$, $Si_3N_4$, $SiO_2$.

Because the material of the photocathode is generally hardly conductive, a uniform distribution of the electric potential can be ensured by depositing a conductive layer on the photocathode at the side of the scintillator. This conductive layer must also be transparent in order to enable the passage of the radiation emitted by the scintillator. In the presence of a chemical barrier, the conductive and transparent layer is deposited between the photocathode and the chemical barrier. The following materials may be used: palladium, aluminum, $In_2O_3$, $SnO_2$ or the material ITO which is a mixture consisting of $In_2O_3$ (90%) and Sn $O_2$ (10%).

Figure 5:
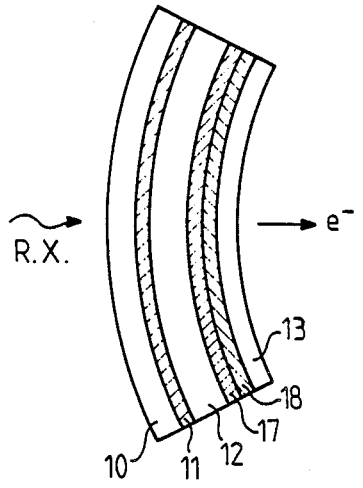
FIG. 5 is a diagrammatic representation which is analogous to that shown in FIG. 1, with and addition a chemical barrier and a conductive and transparent layer arranged between the scintillator and the photocathode.

Thus, an entrance window as shown in FIG. 5 is obtained. Like in FIG. 4, there is provided the aluminium susbstrate 10, the absorbing layer 11, the scintillator 12 and the photocathode 13 which is preferably made of a material having a high photoelectric yield. As a supplement, in contact with the photocathode, there is provided the conductive and transparent layer 18, preceded by the chemical barrier 17. The low-index layer 19 of FIG. 4 can be associated with a conductive and transparent layer 18 and with the chemical barrier 17 shown in FIG. 5. Thus, the low-index layer 19 can be deposited between the scintillator 12 and the chemical barrier 17. It can also be deposited between the chemical barrier 17 and the conductive and transparent layer 18.

Figure 6:
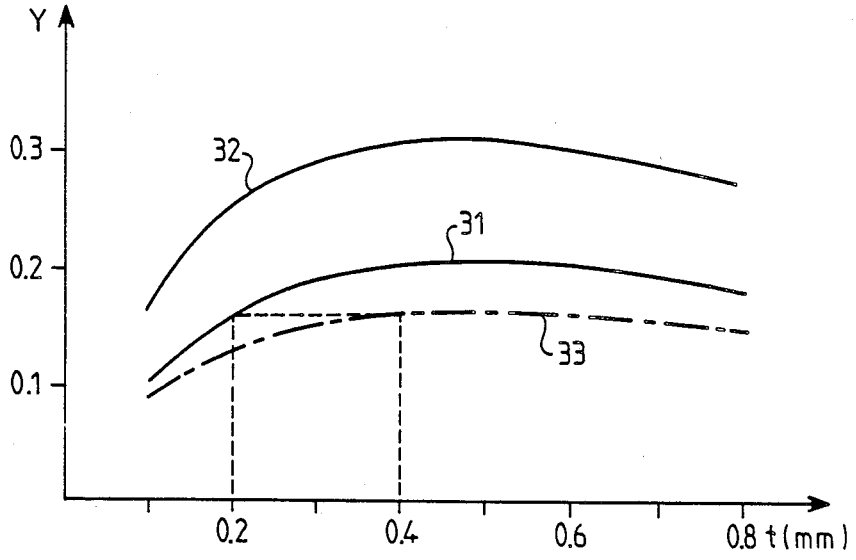
FIG. 6 shows three curves representing the variation of the photoelectric yield for different entrance window constructions in arbitrary units.

The entrance window comprising an absorbing layer, for example of TiN, and a photocathode having a high photoelectric yield, for example made of $K_2CsSb$, will generally offer a photoelectric yield which is superior to that of an entrance window constructed without using these materials. This is demonstrated by FIG. 6 which shows the variations of the photoelectric yield Y of a photocathode as a function of the thickness of the scintillator. The thickness of the photocathode is such that the photoelectric yield is maximum. The curve 31 concerns the structure Al/TiN/CsI, Na/$Al_2O_3$/$K_2CsSb$. Its reflection factor for the light emitted by the scintillator and reflected by the substrate is lower than 10%. The curve 32 concerns the structure Al/CsI, Na/$Al_2O_3$/$K_2CsSb$. Its reflection factor is approximately 70%. The curve 31 is below the curve 32 because the light absorbed is lost and cannot generate electrons. The curve 33 concerns the structure Al/CsI, Na/$Cs_3Sb$. The curve 31 is situated above the curve 33. This means that an entrance window comprising an absorbing layer and a photocathode having a high photoelectric yield can offer an improved performance in comparison with a conventional structure. Moreover, it appears that an entrance window corresponding to the curve 31 can offer a performance equal to that obtained with an entrance window corresponding to the curve 33; it is to be noted that this is achieved with a much smaller thickness of the scintillator. It appears from FIG. 6 that this thickness can be reduced by 0.4 to approximately 0.2 nm. This reduction of the thickness of the scintillator also improves the resolution of the tube for a given thickness (some 10 micrometers) the crystals constituting the scintillator generally exhibits dislocations which cause diffusion of the light. The proposed reduction of the thickness leaves a scintillator thickness which is sufficient in order to ensure that this dislocation zone only slightly disturbs the mechanisms. However, this reduction of the thickness is very important because these X-ray detection tubes necessitate the growth of crystals on the entrance window surfaces with dimensions of several square decimeters. Such a thickness reduction leads to a substantial saving of materials and an improved manufacturing yield.

What is claimed is:

1. An X-ray image intensifier tube, comprising an entrance screen provided with an aluminum substrate which supports a scintillator for transforming X-rays which reach the scintillator through the substrate into visible or nearly visible light radiation which is converted, by way of a photocathode, into a flux of electrons to produce a visible image on an exit screen by electron-optical means, characterized in that a layer which absorbs the light emitted by the scintillator in the direction of the aluminum substrate is provided between the aluminum substrate and the scintillator, the absorbing layer mainly consisting of a material chosen from the group of materials comprising titanium nitride, cadmium sulphide, (Cu, $PbI_2$) and mixtures thereof, and in that a low-index layer, having a refractive index which is lower than that of the photocathode, is inserted between the scintillator and the photocathode.

2. A tube as claimed in claim 1, characterized in that the scintillator is chosen from the following materials: CsI(Na), NaI(Tl), CsI(Tl), $CdWO_4$, $Bi_4Ge_3O_{12}$, $CaWO_4$.

3. A tube as claimed in claim 1, characterized in that the material of the low-index layer is chosen from the following materials: $MgF_2$, cryolite ($Na_3AlF_6$).

4. A tube as claimed in claim 1, wherein the material selected for said absorbing layer is titanium nitride, with said layer having a thickness of at least 50 nm.

5. A tube as claimed in claim 4, characterized in that the thickness is between 75 nm and 120 nm.

6. A tube as claimed in claim 1, wherein the material selected for said absorbing layer is cadmium sulphide, with said layer having a thickness in one of the following ranges: between approximately 115 nm and 135 nm, between approximately 185 nm and 235 nm, and more than approximately 260 nm.

7. A tube as claimed in claim 1, characterized in that the photocathode is chosen from the following materials: $K_2CsSb$, $Rb_2CsSb$, $SbCs_3$, ($SbNa_2K$, Cs).

8. A tube as claimed in claim 7, characterized in that the scintillator is chosen from the following materials: CsI(Na), NaI(Tl), CsI(Tl) $CdWO_4$, $Bi_4Ge_3O_{12}$, $CaWO_4$.

9. A tube as claimed in claim 8, characterized in that the scintillator made of Csi(Na) has a thickness between 100 and approximately 1000 micrometers.

10. A tube as claimed claim 9, characterized in that a chemical barrier is provided between the scintillator and the photocathode, the chemical barrier being chosen from the following materials: $Al_2O_3$, $Si_3N_4$, $SiO_2$.

11. A tube as claimed in claim 10, characterized in that an electrically conductive and optically transparent layer is deposited between the photocathode and the chemical barrier, which layer is chosen from the following materials: palladium, aluminum, in $In_2O_3$, $SnO_2$, a mixture of $In_2O_3$ (90%).

* * * * *